US010500512B2

(12) United States Patent
Culver, II

(10) Patent No.: US 10,500,512 B2
(45) Date of Patent: Dec. 10, 2019

(54) SOFT PRODUCTS HAVING ITEM HOLDERS AND CLOSABLE COMPARTMENTS

(71) Applicant: Robert E. Culver, II, Akron, OH (US)

(72) Inventor: Robert E. Culver, II, Akron, OH (US)

( * ) Notice: Subject to any disclaimer, the term of this patent is extended or adjusted under 35 U.S.C. 154(b) by 0 days.

(21) Appl. No.: 15/959,243

(22) Filed: Apr. 22, 2018

(65) Prior Publication Data

US 2018/0304164 A1 Oct. 25, 2018

Related U.S. Application Data

(60) Provisional application No. 62/602,371, filed on Apr. 21, 2017.

(51) Int. Cl.

| | |
|---|---|
| ***A63H 3/02*** | (2006.01) |
| ***A63H 3/00*** | (2006.01) |
| ***B65D 81/36*** | (2006.01) |

(52) U.S. Cl.
CPC ..... *A63H 3/005* (2013.01); *A63H 3/02* (2013.01); *B65D 81/365* (2013.01)

(58) Field of Classification Search
CPC ..... A63H 3/02; A63H 3/003; A63H 3/005
See application file for complete search history.

(56) References Cited

U.S. PATENT DOCUMENTS 1,445,368 A * 2/1923 Street ..... A63H 3/005 446/268
1,756,048 A * 4/1930 Williams ..... A45C 3/06 150/107
2,396,654 A 3/1946 Herrmann
3,791,550 A * 2/1974 Duncan ..... A47G 19/025 206/457
4,300,307 A 11/1981 Biasuzzi et al.
4,815,999 A * 3/1989 Ayon ..... B65D 81/3886 206/457
4,816,000 A * 3/1989 Hsu ..... A63H 3/005 206/457
5,326,300 A * 7/1994 Sonders ..... A45C 15/00 190/1

(Continued)

OTHER PUBLICATIONS

BabyKeeps, Large Stuffed Animal Storage Bean Bag, "Soft 'n Snuggly", Corduroy Fabric Kids Prefer Over Canvas—Replace Mesh HGammock or Net—Store Blankets/Pillows too, Captured Dec. 20, 2017, from Amazon.com (Year: 2017).*

(Continued)

*Primary Examiner* — John A Ricci
(74) *Attorney, Agent, or Firm* — E.D. Jorgenson Law, LLC; Eric Jorgenson

(57) ABSTRACT

A product having features that facilitate the use of items (e.g., child toys, food items, non-food items, etc.) by way of stuffed creatures ("comfort creatures"). The products can incorporate features such as a compartment to enclose consumable (edible) items such as food and/or drink, and/or non-consumable items so as to hold small gift items for presentation or gifting to another person. The product can be provided with cup-holders embedded into limbs as the stuffed animal is oriented in an upright position. Thus, drink containers can be set into the cup-holders and positioned in a stable manner for use by the child and/or adult. A tray system can also be provided in the main body and removed for standalone use.

20 Claims, 7 Drawing Sheets

(56) References Cited

U.S. PATENT DOCUMENTS

| | | | | |
|---|---|---|---|---|
| 5,601,469 | A * | 2/1997 | Yang | A63H 3/003 411/339 |
| 5,713,781 | A * | 2/1998 | Castanis | A63H 3/005 446/369 |
| 5,906,763 | A * | 5/1999 | Warren Van Deventer Wheeler | A63H 3/003 206/457 |
| 6,142,846 | A | 11/2000 | Ojakaar | |
| 6,699,100 | B1 | 3/2004 | Burns | |
| 6,824,112 | B2 * | 11/2004 | Lange | A61J 9/0607 248/102 |
| 8,152,587 | B1 * | 4/2012 | Brown | A63H 3/02 206/216 |
| 9,119,377 | B2 | 9/2015 | Gratza | |
| 9,968,861 | B2 * | 5/2018 | Brown, Sr. | A63H 3/005 |
| 2011/0001892 | A1 | 1/2011 | Gay | |
| 2012/0028532 | A1 * | 2/2012 | Thompson | A63H 3/003 446/73 |
| 2013/0087572 | A1 | 4/2013 | Dinges et al. | |
| 2013/0331000 | A1 | 12/2013 | Drozdowski | |
| 2014/0311846 | A1 * | 10/2014 | Beadles | A45C 5/00 190/18 A |
| 2015/0004868 | A1 | 1/2015 | Islam | |

OTHER PUBLICATIONS

GoFloats, GoFloats Inflatable Floatmingo Drink Holder, captured on Dec. 20, 2017, found at https://www.amazon.com/GoFloats-Inflatable-Floatmingo-Holder-Drinks/dp/B01EYYRF64/ref=sr_1_1?ie=UTF8&qid=1524093871&sr=8-1&keywords=gofloats+drink+holders.

Stuffies, Stuffies Baby Scout The Monkey, Soft and Cute Plush Stuffed Animal Toy for Kids and 2 Friendship Bracelets, captured on Dec. 20, 2017, found at https://www.amazon.com/Stuffies-Monkey-Stuffed-Friendship-Bracelets/dp/B00IX41UTK/ref=sr_1_4?ie=UTF8&qid=1524094012&sr=8-4&keywords=stuffies+stuffed+animals.

Kohl's Cares, Kohls Dr. Seuss There's a Wocket in My Pocket 18" Plush, captured on Dec. 20, 2017, found at https://www.amazon.com/Kohls-Seuss-Theres-Wocket-Pocket/dp/B0045STOH8/ref=sr_1_1?s=toys-and-games&ie=UTF8&qid=1524094559&sr=1-1&keywords=kohls+dr.+seuss+wocket.

Kawaii, New Child Car Seat Tray Waterproof Storage Children Toy Holder Tray Desk Infant Stroller Board Table Child Car Seat Tray, captured on Dec. 20, 2017, found at https://www.dhgate.com/product/new-child-car-seat-tray-waterproof-storage/400201498.html#s1-0-1b;searl|3534592399.

6pcs/set Kitchen Dining Table Cutlery Suit Set Christmas Decorations for Home Snowman Cutlery Bags Christmas Santa Claus Christm, captured on Dec. 20, 2017, found at https://www.dhgate.com/product/6pcs-set-christmas-decorations-for-home-snowman/405789959.html?m=5|ff8080815e942056015eb7ef78f33659||405789959|#gp-0-3|ff8080815f25413c01622de9979f0163.

WHouseDesigns, Monogrammed Toddler Backpacks, Backpacks, Preschool backpack, captured on Dec. 20, 2017, found at https://www.etsy.com/listing/550833865/monogrammed-toddler-backpacks-backpacks?ref=shop_home.

BatGirlDesigns, Camo Bat Stuffed Animal, Coffee Cozy, Toy, Cup Sleeve, captured on Dec. 20, 2017, found at https://www.etsy.com/listing/55312788/camo-bat-stuffed-animal-coffee-cozy-toy?ga_order=most_relevant&ga_search_type=all&ga_view_type=gallery&ga_search_query=camo bat stuffed coffee&ref=sr_gallery-1-1.

DaisyMaeandMe, Four Jay Crafts Buddy Bear Sofa Cup Holder Friend UNCUT, captured on Dec. 20, 2017, found at https://www.etsy.com/listing/226858091/four-jay-crafts-buddy-bear-sofa-cup?ga_order=most_relevant&ga_search_type=all&ga_view_type=gallery&ga_search_query=buddy bear holder&ref=sr_gallery-1-24.

MugMonsters, Mini-Mug Monster—Thermos Beverage Snack Drink Plush Toy Lunch Mason Jar Bag—Neon Green Pinstripe GloWorm Orange Faux Fur, captured on Dec. 20, 2017, found at https://www.etsy.com/listing/118380881/mini-mug-monster-thermos-beverage-snack?ga_order=most_relevant&ga_search_type=all&ga_view_type=gallery&ga_search_query=mini mug monster thermos&ref=sr_gallery-1-2.

HagerdesignAtHome, Ugly monster plushie Beige Weird softie, captured on Dec. 20, 2017, found at https://www.etsy.com/listing/188142341/ugly-monster-plushie-beige-weird-softie?ga_order=most_relevant&ga_search_type=all&ga_view_type=gallery&ga_search_query=monsterplushie&ref=sr_gallery-1-45.

AndromedaEnterprises, Secret Stash Stuffed Monkey with Hidden Pockets Large Size Stuffed Gorilla Ape Monkey Keepsake Holder Jewelry Hidey Hole OlyTeam, captured on Dec. 20, 2017, found at https://www.etsy.com/listing/204104061/secret-stash-stuffed-monkey-with-hidden?ga_order=most_relevant&ga_search_type=all&ga_view_type=gallery&ga_search_query=secret stash stuffed monkey&ref=sr_gallery-1-1.

Sentry Baby Products, Sentry™ Guardimal™ Booster Bear, captured Dec. 20, 2017, found at https://www.sentrybabyproducts.com/product/sentry-guardimal-booster-bear/.

Melissa & Doug, Melissa & Doug Sunny Patch Clicker Crab Chair, captured on Dec. 20, 2017, similar product found at https://www.shop.com/search/pretend+play+clicker+crab.

Lloyd, Lisa, Treasure Chest Pets, Stuffed Animals with Secret Compartments, captured on Dec. 20, 2017, found at https://www.bing.com/videos/search?q=http%3a%2f%2fgettreasurechestpets.com%2f&view=detail&mid=F69C4CED2F9D9C503810F69C4CED2F9D9C503810&FORM=VIRE.

* cited by examiner

SOFT PRODUCTS HAVING ITEM HOLDERS AND CLOSABLE COMPARTMENTS

CROSS-REFERENCE TO RELATED APPLICATIONS

This application claims the benefit of U.S. Provisional Patent Application Ser. No. 62/602,371 entitled "Indeed inflammation intimacy Stuffed animal snack shelf that folds down to hold cups (bottles) and snack bowl tray can be either fixed or de-tatchable", and filed Apr. 21, 2017, the entirety of which is incorporated by reference herein.

BACKGROUND

Soft products such as stuffed animals for children and adults are abundant in the marketplace for use indoors and outdoors. In particular, soft products in the form of animals such as bears, horses, puppies, etc., are available, but targeted primarily for use by children. However, products produced for children, teens, and adults, lack utility other than typical interactions such as touching, holding, carrying, hugging, etc. Moreover, parents are no longer satisfied with such minimal utility in these products. A recognized shortcoming of existing soft products are features that provide enhanced utility.

SUMMARY

The following presents a simplified summary in order to provide a basic understanding of some novel embodiments described herein. This summary is not an extensive overview, and it is not intended to identify key/critical elements or to delineate the scope thereof. Its sole purpose is to present some concepts in a simplified form as a prelude to the more detailed description that is presented later.

The disclosed innovative products (e.g., soft) include product features that facilitate the use of items (e.g., child toys, food items, non-food items, etc.) by way of stuffed creatures ("comfort creatures"). In support thereof, the products can incorporate features such as a compartment to accommodate child and adult consumable (edible) items such as food and/or drink, and/or non-consumable items so as to hold small gift items for presentation or gifting to another person.

In other words, these features can include, but are not limited to, containers and compartments such as a (snack) bowl, drink holder, a compartment in which to house/secret away small items, a way to hold baskets or the like in which to set and present items such as flowers, candy, and so on.

In one implementation, a product as a soft stuffed animal (a creature) can be provided in which cup holders are embedded in one or more limbs of the stuffed animal. When the stuffed animal is oriented in a suitable upright orientation, a container of liquid (e.g., water, drinks), for example, can be placed into a cup holder and used therefrom. Thus, drink containers can be placed into the cup holders and positioned in a stable manner (e.g., non-spill) for use by the child and/or adult.

In another implementation, the stuffed animal includes a compartment system as a single unit that comprises a compartment and compartment cover (e.g., shaped as a bowl). The compartment part of the compartment system is embedded into the front abdominal area of a main body of the stuffed animal, such that the compartment cover securely encloses (stays closed on its own) any item in the compartment while the stuffed animal is tossed about or handled.

Once properly oriented, the compartment cover can be lifted up and back (e.g., in a hinged manner) to expose the item(s) in the compartment, for consumption or access by the intended person (e.g., a child).

It can be the case that the compartment cover is not hingedly designed to the compartment, rather the compartment is embedded into the front abdomen of the main body of the animal, so that the compartment cover (e.g., bowl shaped) is hingedly rotated up to engage the compartment and securely capture the item(s) enclosed in the compartment. This can be a handling or carrying method for the stuffed creature and product until such time as the user chooses to expose the item(s) to the intended person and in the intended way.

In yet another implementation, the stuffed creature can be shaped as a marine animal such as a dolphin, where the "breathing hole" of the dolphin is fitted to accommodate a cup holder, and the dorsal fin is or includes the compartment cover (over an embedded compartment), which can be removed and/or folded back to expose the compartment that holds an item such as a food product and/or small non-consumable item (e.g., a ball, gift, basket, etc.).

In still another implementation, the front and/or back abdominal section (main body) of the stuffed animal can accommodate a drink container (e.g., a cup/cover having a straw, a canned drink, etc.). Thus, the animal becomes the means by which the user holds the drink container and consumes the liquid therefrom, or holds dry food product in ajar, or other container type for consumption, gifting a non-consumable item, etc.

In another implementation, the front abdominal section of the main body of a creature includes a tray system having a housing, a frame for a flip-down tray, and the flip-down tray, which serves to hold one or more drink containers and on which food or other items can be set (like a miniature table top), and that when flipped up in a closed position, can be latched closed. The tray system can be made detachable from the creature to use separately (standalone) from the creature or to enable use of the stuffed creature without the tray system.

In still another implementation, the detachable tray and drink holder system can employ a multi-point attachment mechanism to the stuffed animal by way of one or more of the main body and limbs. For example, hook-and-loop material can be used as the attachment mechanism between the tray/holder and the main body, the tray/holder and the inside areas of the arms/legs, and/or the tray/holder and top areas of the legs of the stuffed creature.

In other words, a soft product in a shape of a creature is provided, comprising: a product cover fabricated into the shape of the creature and member parts of the creature, the product cover stuffed with stuffing material to hold the shape of the creature and the member parts in a predetermined orientation; and a compartment system formed into a member part and capable of receiving an item, the compartment system comprising a compartment into which the item is placed and a compartment cover that mates to the compartment to capture the item in the compartment and enable access to the item.

Alternatively, a product in a shape of a creature is provided, comprising: a product cover fabricated into the shape of the creature and member parts of the creature, the member parts include at least a head and a main body, the product cover stuffed with stuffing material to hold the shape of the creature and the member parts; and a compartment and a compartment cover formed into the main body member part and capable of receiving an item, the compartment cover attached to the compartment to enclose the item in the compartment and enable access to the item.

In yet another implementation, a product in a shape of a creature is provided, comprising: a product cover fabricated into the shape of the creature and member parts of the creature, the member parts include at least a head and a main body, the product cover stuffed with stuffing material to maintain the shape of the creature, maintain orientation of the creature, and maintain orientation of the member parts relative to the main body; and a compartment and a compartment cover formed into the main body member part, through the product cover, and capable of receiving an item, the compartment cover attached to the compartment to enclose the item in the compartment for storage and enable access to the item when open, the compartment and compartment cover removable from main body for use as a standalone unit.

To the accomplishment of the foregoing and related ends, certain illustrative aspects are described herein in connection with the following description and the annexed drawings. These aspects are indicative of the various ways in which the principles disclosed herein can be practiced and all aspects and equivalents thereof are intended to be within the scope of the claimed subject matter. Other advantages and novel features will become apparent from the following detailed description when considered in conjunction with the drawings.

DETAILED DESCRIPTION

Figure 1:
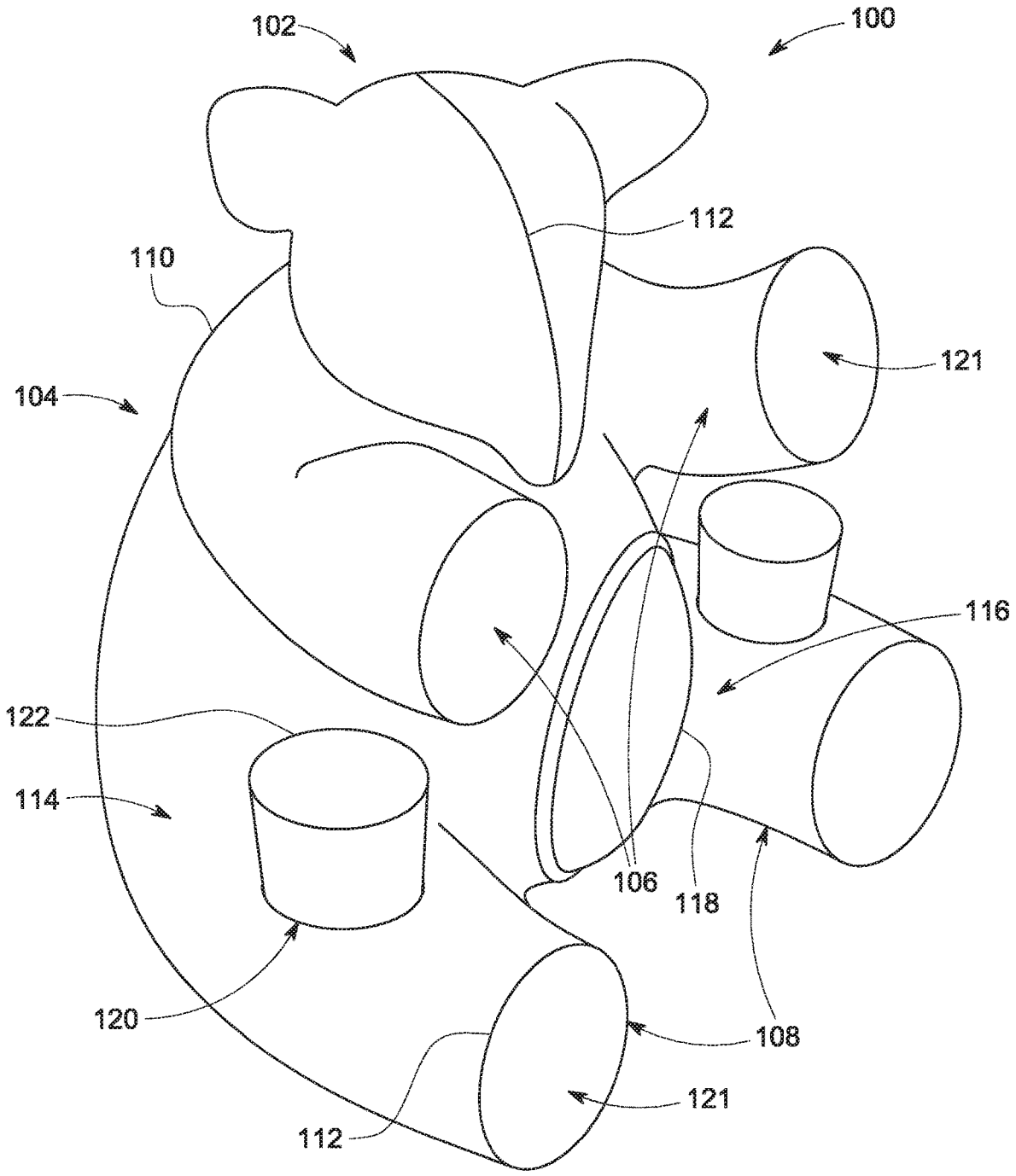
FIG. 1 illustrates a product in accordance with the disclosed innovation.

The disclosed products (e.g., soft) include product features that facilitate the use of items (e.g., child toys, food items, non-food items, etc.) by way of stuffed (soft) creatures. In support thereof, the products can incorporate features such as a compartment system to accommodate consumable (edible) items such as food and/or drink, and/or non-consumable items so as to hold small gift items, for example, for presentation or gifting to another person. The compartment system can include the compartment and a compartment cover that fits over the compartment to capture (enclose) the item placed in the compartment.

In one implementation, a stuffed animal can be provided in which drink cup holders are embedded in one or more limbs for use when the stuffed animal is oriented in an upright position. Thus, drink containers can be set into the cup holders and positioned in a stable manner according to the orientation of the stuffed animal for use by the user (e.g., child, adult, parent, etc.). Without these features, a parent (a user), for example, would need to carry the food/drink separately and ultimately find a way in which to position the food/drink in a stable manner for access by the child, for example.

While the product is described as mimicking the shape of a creature (any of a living thing), it is to be understood that the product need not be limited to a creature, but can be non-creature such as an object commonly known to not be a living entity, such as a block, box, ball, etc. Thus, a creature is defined to comprise any animal and a human, where the animal is any living thing other than a human such as a plant, mammal, bird, reptile, insect, fish, etc.

Reference is now made to the drawings, wherein like reference numerals are used to refer to like elements throughout. In the following description, for purposes of explanation, numerous specific details are set forth in order to provide a thorough understanding thereof. It may be evident, however, that the novel embodiments can be practiced without these specific details. The intention is to cover all modifications, equivalents, and alternatives falling within the spirit and scope of the claimed subject matter.

FIG. 1 illustrates a product 100 in accordance with the disclosed innovation. The product 100 can be a soft product which is encased in a flexible and resilient cover of stuffing material and/or fabric. The product 100 serves as a huggable and cuddly article for the user. The user can take (e.g., grasp) the product 100 in its original non-deformed state, then squeeze, embrace, etc., the product 100 to a temporarily deformed state, and once released, the soft product returns to the original non-deformed state.

Continuing, the product 100 can be in the shape of a creature (e.g., bear, gorilla, dolphin, shark, human, etc.). The shape is intended to mimic zero, some, or all the features and appearance of what is commonly-known to be associated with the creature (e.g., human or animal). At a minimum and as described herein, the creature will have at least two body parts: a head, and a main body (includes the neck to the rump).

The other features can be different depending on the creature. For example, where the creature is land-based two-legged or four-legged, the member parts include the head and main body, and can further include other member parts, also referred to as limbs (e.g., arms, legs, etc.). In another example, where the creature is a marine animal, the member parts include the head and main body, and can further include fins (e.g., dorsal, tail, etc.). In yet another example, where the creature is a bird or bird-like and capable/incapable of flight, the member parts include the head and main body, and can further include limbs such as legs and wings.

For example, where the creature is a bear, the bear features and appearance can include a typical bear-like head (with zero, some, or all head features such as nose, eyes, ears, etc.), a main body of the bear (where the main body includes zero, some, or all features from the neck to the tail such as back and underside), front legs (that extend from the main body near the head end and include zero, some, or all features normally observed on or associated with the front legs of a bear, such as paws), and rear legs (that extend from the main body near the tail end and include zero, some, or all features normally observed on or associated with the rear legs of a bear such as paws).

The product 100 of FIG. 1 represents a bear. For the bear creature, the member parts include the head 102 and main body 104, as well as limbs such as front legs 106 and rear (or hind) legs 108. Where the creature is a human, the member parts include the head and main body, as well as limbs such as arms and legs. For a primate (e.g., gorilla, chimpanzee, etc.) the member parts include the head and main body, as well as limbs such as arms and legs.

Additional and/or other more detailed features can be added to the given product 100; however, this is not a requirement, but an enhancement. For example, the head 102 can further include member parts of eyes, ears, and mouth (none of which are shown), and the main body 104 can further include a tail (not shown). (For marsupials, the main body 104 of the marsupial can include an abdominal (belly) pouch, for example, which is not shown here.)

The product 100 comprises a product cover 110 fabricated into the shape of the creature and member parts of the creature. The product cover 110 can include one or more seams 112 where the various parts of the product cover 110 are joined (e.g., stitched, glued, using fasteners, etc.) together into the overall shape of the creature.

The fabricated product cover 110 can be made of any material suitable for the given application. For example, where the product 100 is intended to be used in dry environments (e.g., home) away from water areas such as ponds, pools, bath tubs, etc., to mitigate semi-submersion and full submersion the product cover 110 can be a durable canvas fabric, polyesters, acrylic coated polyesters, nylon, cotton outer layer, and so on. A water-resistant fabric or coating material can also be utilized to mitigate sustained wetness on the cuddly creature by repelling moisture and any form of wetness in dry and wet environments.

The product cover 110 can be stuffed with stuffing material 114 that is designed to hold the shape of the creature and the member parts. Thus, the stuffing material 114 can incorporate suitable stiffness (firmness), and when inserted into the member parts of product cover 110 according to a predetermined stuffing insertion parameter(s), enables the member parts to hold shape and orientation under most instances of user interaction. That is, "holding shape" is intended to mean that member parts such as the limbs maintain orientation as shown and provided at the time of purchase, and throughout extended use of the product 100 over time.

The stuffing material 114 can include any material suitably designed/available to provide the desired product orientation effects for upright use and limb orientations, such as closed-cell foam cushion, unicellular polyurethane foam, and more resilient foam and materials that invite an appealing, cuddly, and squeezable user interaction.

As illustrated in FIG. 1, the stuffing material 114 is of a sufficient density, stiffness, and applied insertion pressure that the member parts enable the creature to retain an upright and sitting position. This particular creature orientation is perceived by the user (e.g., a child) as reaching out to engage the user. Additionally, as is commonly-known in child rearing and child behavior (while not restricted for use by children, but available for teens and adults as well), outstretched arms typically convey a message of "hold me", "pick me up", and so on, thereby inviting the user to hold or cuddle the creature (product).

In describing other optional features of the product 100, a feature such as a compartment system 116 can be formed (constructed) into a member part (e.g., main body) and can be capable of receiving an item (not shown). The compartment system 116 is intended to mean a covered enclosure in which the item is placed. The compartment system 116 can be constructed into the main body 104 with or without a compartment cover 118. The item(s) can be any object the user chooses to place (e.g., store) in the compartment (not visible) of the compartment system 116, such as play items, food items, clothing items, and so on.

It is to be understood that in the disclosed product, certain features may be rearranged, combined, and omitted, and additional features may be included.

For example, alternatively, it is to be understood that the compartment system 116 can be made to be located as a single compartments system as part of the creature mouth or be a second compartment system located as part of the creature mouth in addition to the compartment system in the main body. Thus, the compartment of the compartment system would be recessed into the mouth/jaw parts and closed/opened via a closure mechanism such as a zipper, magnets, hook-and-loop technology, etc.

The compartment system 116 can also include the compartment cover 118 attached to the compartment system 116 to capture (e.g., enclose) the item and enable access to the item. The compartment in which an item can be placed can be recessed into the main body 104 so that the open (or access) side of the compartment is approximately flush with the product cover 110 of the main body 104 at that compartment location. The compartment geometry can be cylindrical, rectangular, square, elliptical, etc., with the compartment cover 118 matching the compartment geometry of the access side in order to provide a mating fit of the rim of the compartment cover 118 to the rim of the compartment. The method of attachment or interface of the compartment cover 118 to the compartment system 116 can be via many different ways, including but not limited to, magnets, hook-and-loop technology (e.g., Velcro™), zippers, snaps, buttons, and so on.

Where the method of attachment (or interface) of the compartment cover 118 to the compartment 202 is magnetics, the compartment cover 118 employs a magnet attached thereto (e.g., along the rim) and that enables magnetic coupling to a magnet affixed to the compartment 202 (e.g., rim). In this implementation, the compartment cover 118 can be entirely removable by the user simply pulling the compartment cover 118 away from the compartment 202, and then replacing the compartment cover 118 when desired. The inside of the compartment 202 can be lined with any suitable material for the intended purpose, for example, cloth, water repellant fabric, a logo embossed material, uncovered plastic, and so on.

In this rendition of the product 100, the ends 121 of the bear limbs can be made substantially flat or rounded where the paws would normally be on an actual bear. This feature facilitates orienting the bear on all four ends in a normally walking orientation of a live bear, rather than a sitting-up orientation, as shown.

At least one of the member parts (e.g., a rear leg) can include a cup holder 120 constructed thereinto to receive a container 122 (e.g., drink, food, non-food, etc.) in a non-spill orientation. Here, there is provided a cup holder constructed in each rear leg of the bear to receive a drink container in a non-spill orientation, for example, when the bear is in the sitting-up orientation.

Figure 2:
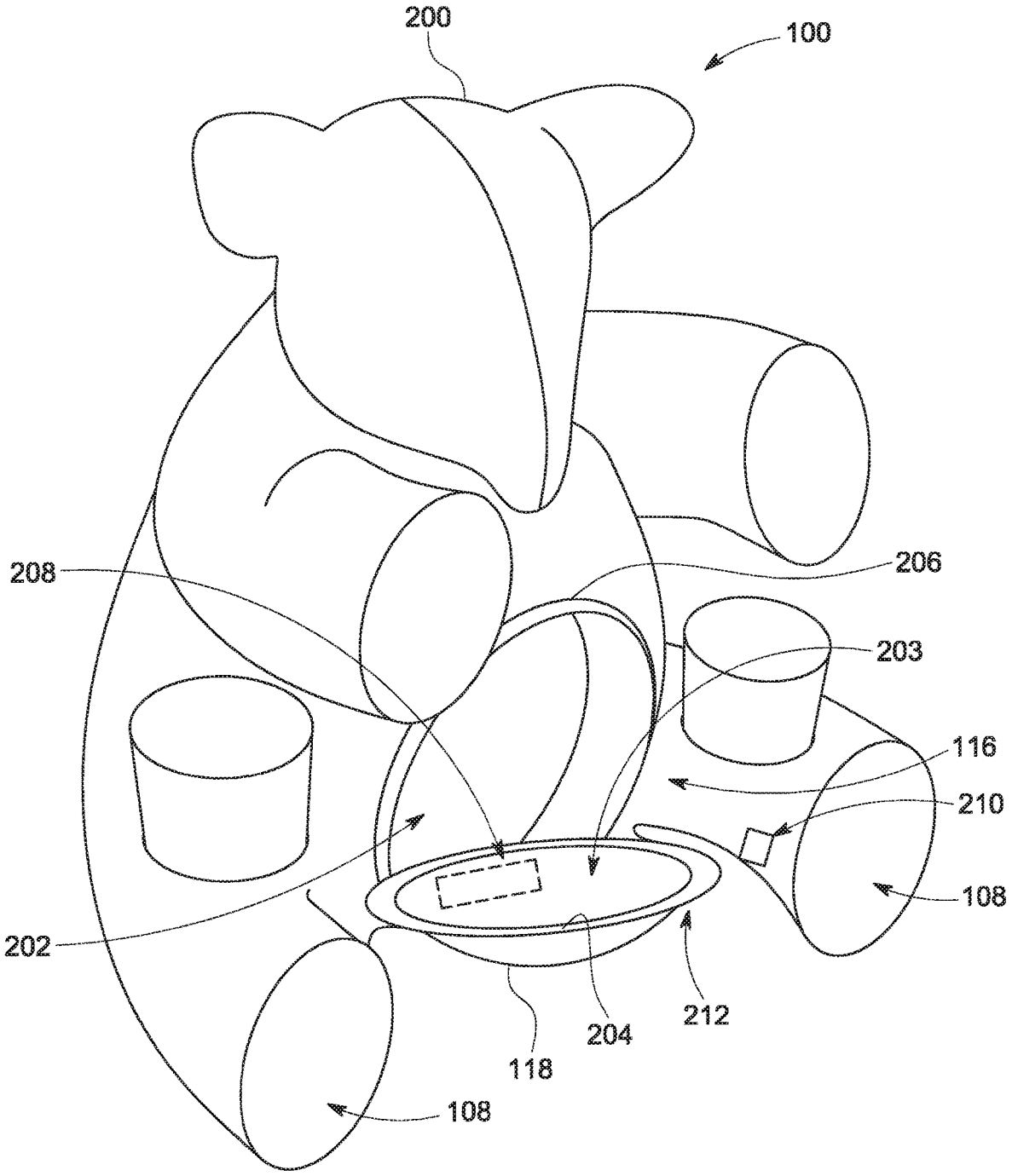
FIG. 2 illustrates the product as a bear with a compartment cover in an open position.

FIG. 2 illustrates the product 100 of FIG. 1 as a bear 200 with the compartment cover 118 in an open position. The compartment system 116 shows an exposed compartment (cavity) 202, and the compartment cover 118 in an open and substantially horizontal position as a platform on which an item (e.g., toy) or items (e.g., candy) can be placed and utilized. In another design, the compartment cover 118 can be a concave shape having an inwardly-curved surface 203 (of a typical bowl shape) that when the compartment cover 118 is open, the inwardly-curved surface 203 faces upward, and when closed, the inwardly-curved surface 203 faces the interior of the compartment 202.

In any case, compartment system 116 comprises a closure apparatus system (e.g., mating rims, cover/compartment surfaces, contact points, hinge or hinge-like item, etc.). The closure apparatus system includes a compartment cover closure apparatus 204 which is affixed to the rim of the compartment cover 118, and a compartment closure apparatus 206 which is part of (e.g., affixed) the perimeter of the compartment 202. Thus, the compartment cover 118 can include the compartment cover closure apparatus 204 which mates to the compartment closure apparatus 206 of the compartment 202.

The closure apparatus system can also be designed to include or function as a seal that when closed prevents unwanted effects (e.g., moisture, dust, etc.) from entering the compartment 202.

The closure apparatus system can further include hinged open/closure apparatus 208 (shown as a dashed-line box). Many different types of hinges can be employed. For example, a spring-loaded hinge having one part attached to the compartment 202 and the other part attached to compartment cover 118. When the compartment cover 118 is opened, the hinge holds the compartment cover 118 in the open position, and when closed the hinge holds the compartment cover 118 in the closed position.

In one implementation, a tensioned hinge can be utilized such that when the user opens the compartment cover 118 (which for the bear 200 opens in a pivoted downward position), the user applies a pulling force to overcome the design tension of the hinge. Once the tension is overcome, the compartment cover 118 automatically opens to a preset swing limit of the hinge such that the compartment cover 118 is in a horizontal orientation where an item placed on the upward face (interior face of the compartment cover 118) will not slide off.

In reverse, when the user then overcomes the hinge tension in an upward lifting motion of the compartment cover 118 to close the compartment cover 118, the tensioned hinge operates to automatically close the compartment cover 118 so that the closure apparatus of the compartment cover 118 and compartment 202 mate in alignment to provide a seal that prevents foreign material from entering the compartment system 116.

In another alternative implementation, when the compartment cover 118 is in the open position, the compartment cover 118 can be captured (e.g., temporally attached by hook-and-loop material such as VELCRO) in a suitable position (e.g., the compartment cover in relatively horizontal to hold liquid, solids, toys, etc.) by the rear legs 108 of the bear 200 to provide additional stability for using the compartment cover 118 as a platform, bowl, etc. More specifically, this alternative implementation can employ strategically placed hook-and-loop attachment parts 210: the attachment parts 210 on inside areas of the rear legs 108 can be connected to (mate) attachment parts 212 on the compartment cover 118.

For example, the attachment parts 210 can include short tethers (or straps) which can be designed to reach from the legs 108 to the compartment cover 118 to further provide stability of the compartment cover 118 when in the open position. The attachment parts 210 can be applied to the desired locations of the bear 200 for convenient user access, for example, where the legs 108 normally contact the compartment cover 118 when the compartment cover 118 is in the open position.

Figure 3:
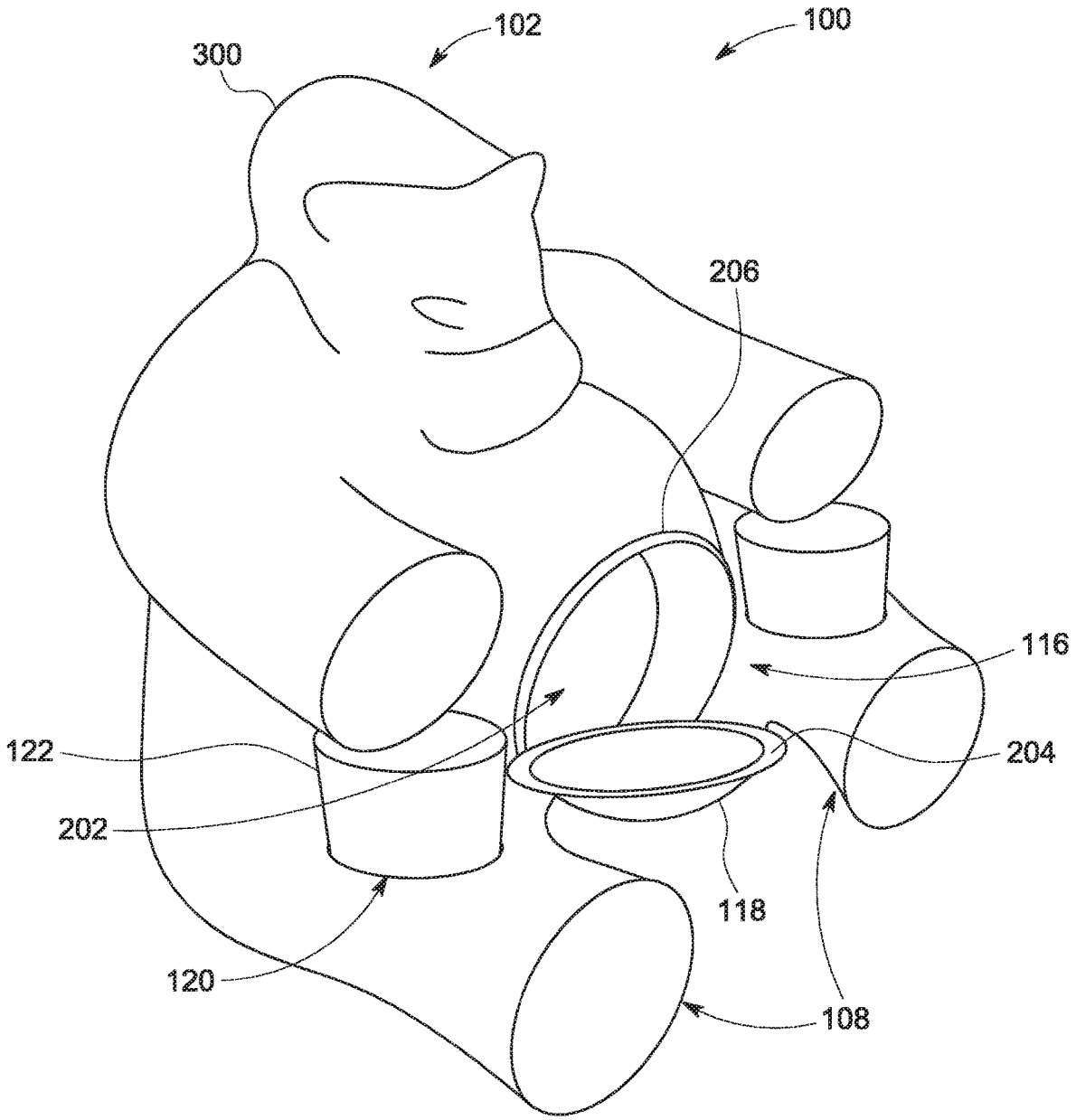
FIG. 3 illustrates the product as a primate.

FIG. 3 illustrates the product 100 of FIG. 1 as a primate 300 (e.g., gorilla). The primate 300 can incorporate the same features and capabilities as the bear 200 of FIG. 2, with the exception that the head 102 is that of a primate (e.g., gorilla, chimpanzee, etc.). The primate 300 is shown in an upright sitting position with arms and legs extended forward in a substantially horizontal orientation and with the compartment cover 118 in an open position. This overall primate 300 orientation is the same as shown for the product 100 of FIG. 1 and the bear 200 of FIG. 2.

The compartment system 116 shows the exposed compartment (cavity) 202, and the compartment cover 118 in an open and substantially horizontal position as a platform on which an item (e.g., toy, food, etc.) or items (e.g., candy) can be placed. In another design, the compartment cover 118 can be a concave shape having an inwardly-curved surface (of a typical bowl shape) on the interior surface that when the compartment cover 118 is open, the inwardly-curved surface faces upward, and when closed, the inwardly-curved surface faces the compartment 202.

Other notable features similar to those of the product 100 of FIG. 1, include that the primate 300 can be a soft product which is encased in a flexible and resilient cover of material and/or fabric. The primate 300 serves as a huggable and cuddly article for the user (e.g., from child to adult). The user can grasp the primate 300 in its original non-deformed state, then squeeze, embrace, etc., the primate 300 to a temporarily deformed state, and once released, the primate 300 returns to the original non-deformed state.

The shape is intended to mimic zero, some, or all the features and appearance of what is commonly-known to be associated with the human or animal. At a minimum and as described herein, the creature will have member parts of at least the head and the main body.

Features of the primate 300 include, but are not limited to, the member parts shown for the bear 200 of FIG. 2, such as the head 102 and main body 104, as well as limbs such as front legs 106 and rear (or hind) legs 108.

Additional and/or other more detailed features can be added to primate 300; however, this is not a requirement, but an enhancement. For example, the head 102 can further include member parts of eyes, ears, and mouth (none of which are shown), and the main body 104 can further include a tail (not shown).

The primate 300 can comprise the details associated with the product 100 of FIG. 1, such as the product cover 110 fabricated into the shape of the creature and member parts of the creature. The product cover 110 can include one or more seams 112 where the various parts of the product cover 110 are joined (e.g., stitched, glued, using fasteners, etc.) together into the overall shape of the creature.

The fabricated product cover 110 can be made of any material suitable for the given application. For example, where the primate 300 is intended to be used in dry environments (e.g., home) away from water areas such as ponds, pools, bath tubs, etc., to mitigate semi-submersion and full submersion the product cover 110 can be a durable canvas fabric, polyesters, acrylic coated polyesters, nylon, cotton outer layer, and so on. A water-resistant fabric or coating material can also be utilized to mitigate sustained wetness on the cuddly creature by repelling moisture and any form of wetness in dry and wet environments.

The product cover 110 can be stuffed with the stuffing material 114 that is designed to hold the shape (original) of the primate 300 and the member parts. Thus, the stuffing material 114 can incorporate suitable stiffness (firmness), and when inserted into the member parts of product cover 110 according to a predetermined stuffing insertion parameter(s), enables the member parts to hold shape and orientation under most instances of user interaction. That is, "holding shape" is intended to mean that member parts such as the limbs maintain orientation as shown and provided at the time purchase, throughout extended use of the primate 300 over time.

The stuffing material 114 can include any material suitably designed/available to provide the desired product orientation effects for upright use and limb orientations, such as closed-cell foam cushion, unicellular polyurethane foam, and more resilient foam and materials that invite an appealing, cuddly, and squeezable user interaction.

As described in FIG. 1, the stuffing material 114 is of a sufficient density, stiffness, and applied insertion (stuffing) pressure that the member parts enable the creature to obtain and retain the desired use parameters, such as an upright position, crawling position, and a sitting position. This particular creature orientation is perceived by the user (e.g., a child) as reaching out to engage the user. Additionally, as is commonly-known in child rearing and child behavior (while not restricted for use by children, but available for teens and adults as well), outstretched arms typically convey a message of "hold me", "pick me up", and so on, thereby inviting the user to hold or cuddle the creature (product).

In describing other optional features of the primate 300, the compartment system 116 can be formed (constructed as recessed) into the main body 104 and can be capable of receiving an item (not shown). As before, the compartment system 116 is intended to mean a covered enclosure in which the item is placed and which can be accessed by moving the compartment cover. The compartment system 116 can be constructed in the main body 104 with or without a compartment cover 118. The item(s) can be any object the user chooses to place (e.g., store) in the compartment 202 of the compartment system 116, such as play items, food items, clothing items, and so on.

The compartment system 116 can also include the compartment cover 118 attached to the compartment framework to capture (e.g., enclose) the item and enable access to the item. The method of attachment or interface of the compartment cover 118 to the compartment 202 can be via many different ways, including but not limited to, magnetics, hook-and-loop technology (e.g., Velcro™), zippers, snaps, buttons, and so on.

As described in FIG. 2 for the compartment system 116, where the method of attachment (or interface) of the compartment cover 118 to the compartment 202 is magnetics, the compartment cover 118 employs a magnet attached thereto (e.g., along the rim) and that enables magnetic coupling to a magnet affixed to the compartment 202 (e.g., rim). In this implementation, the compartment cover 118 can be entirely removable by the user simply pulling the compartment cover 118 away from the compartment 202, and then replacing the compartment cover 118 when desired. The inside of the compartment 202 can be lined with any suitable material for the intended purpose, for example, cloth, water repellant fabric, a logo embossed material, uncovered plastic, and so on.

In this rendition of the primate 300, the ends of the primate limbs can be made substantially flat or rounded where the hands and rear feet would normally be on an actual primate. This feature facilitates orienting the primate 300 on all four ends, rather than a sitting-up orientation, as shown.

At least one of the member parts (e.g., a rear leg) can include the cup holder 120 constructed thereinto to receive the drink container 122 in a non-spill orientation. Here, there is provided the cup holder 120 constructed into each rear leg 108 of the primate to receive the drink container 122 in the non-spill orientation, when the primate 300 is in the sitting-up orientation, as shown.

Figure 4:
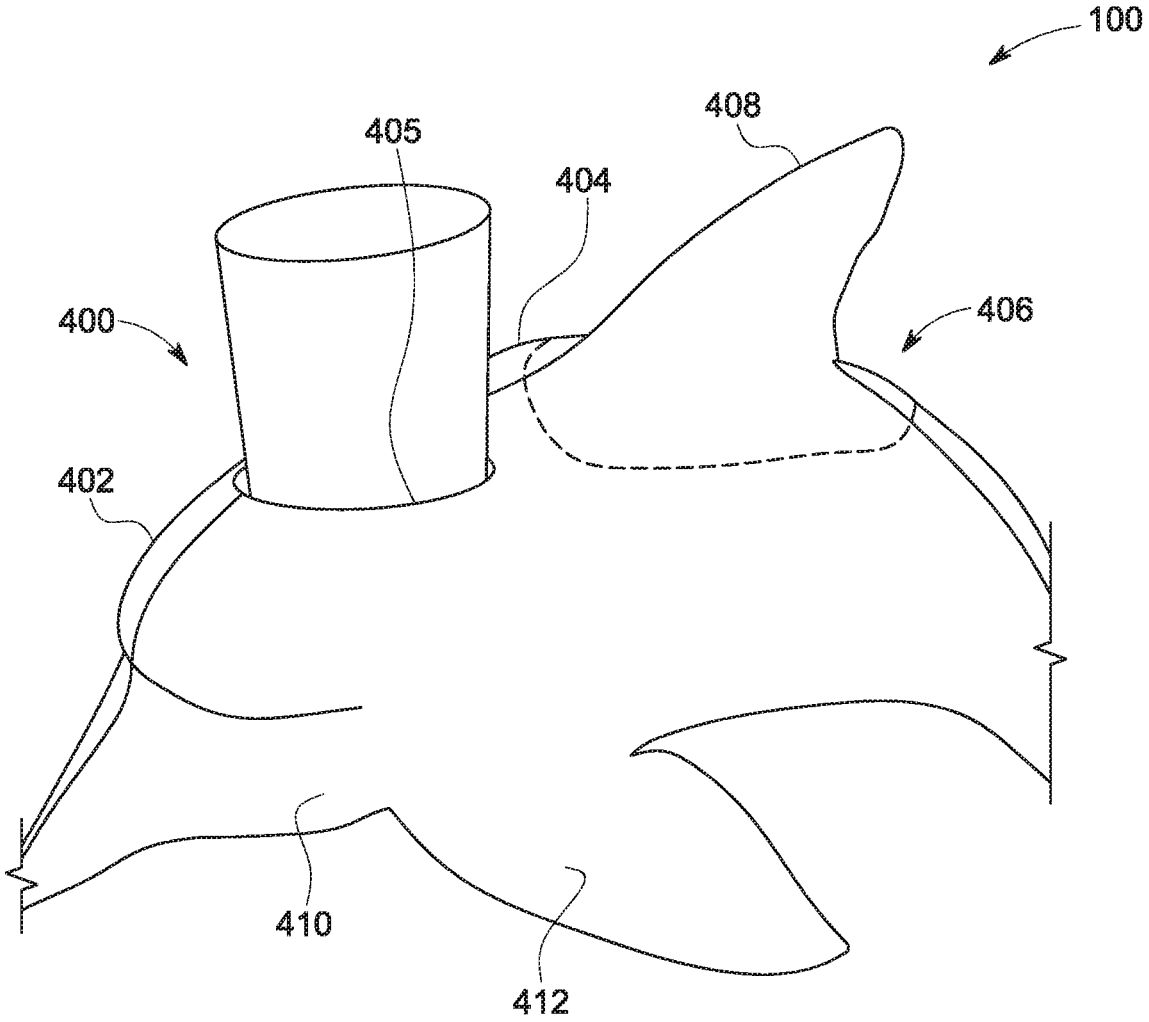
FIG. 4 illustrates the product as a marine animal.

FIG. 4 illustrates the product 100 as a marine animal 400 (e.g., a dolphin, shark, squid, octopus, coral, etc.). Here, the marine animal 400 includes member parts of at least a head 402 and main body 404. The head 402 includes a holder 405 (e.g., similar to the cup holder 120) that accommodates a container (e.g., the drink container 122, soup, etc.). The main body 404 further includes a member part as a dorsal fin. The dorsal fin includes a compartment system 406 for storing an item, if desired, and enclosing the item. The compartment system 406 can be comprised of a compartment cover and internal compartment (cavity) (not visible). As depicted, the compartment cover can be in the shape of the dorsal fin 408 of the marine animal 400.

Alternatively, the compartment cover is underneath and separate from the dorsal fin 408. Thus, the dorsal fin 408 opens to expose the compartment cover, under which is the compartment. The compartment cover and/or dorsal fin 408 can be attached to the main body 404 in several different ways, as described above with the bear 200 and the primate 400. Where the dorsal fin 408 is the compartment cover, the dorsal fin 408 can be attached to the main body 404 using an attachment mechanism as a zipper, magnets, hook-and-loop material, and other techniques described herein.

As described in FIG. 1, the marine animal 400 incorporates stuffing material 410 (similar to stuffing material 114) of a sufficient density, stiffness, and applied insertion (stuffing) pressure that the member parts (e.g., head 402, main body 404, one or more fins, e.g., dorsal fin 408) enable the marine animal 400 to retain a horizontal swimming or resting orientation. It can also be the case that the stuffing material 410 surrounds an internal flexible yet stiff wire frame such that the limbs can be bent to a specific orientation and will then hold this orientation based on the wire frame. The user can then bend this limb back to the previous orientation or to a new orientation. This particular creature orientation provides support stability for the container in the holder, and upward orientation for the compartment when the compartment cover 408 is opened to expose the compartment. The wire frame can be employed in all products described herein.

The marine animal 400 also comprises two additional member parts as pectoral fins 412 (of which only one is visible), which provide overall stability of the marine animal 400 when placed on a flat surface such as a floor or table. Although not shown here, the marine animal 400 can also include a tail fin common to many different kinds of cold and warm-blooded marine creatures such as fish, sharks, etc.

Where the marine animal 400 is the dolphin, the "breathing hole or blowhole" of the dolphin is fitted to accommodate the holder 405, and the dorsal fin 408 can be removed or folded back to expose the compartment that holds one or more items such as a food product and/or small non-consumable item (e.g., a ball, gift, basket, etc.).

Figure 5:
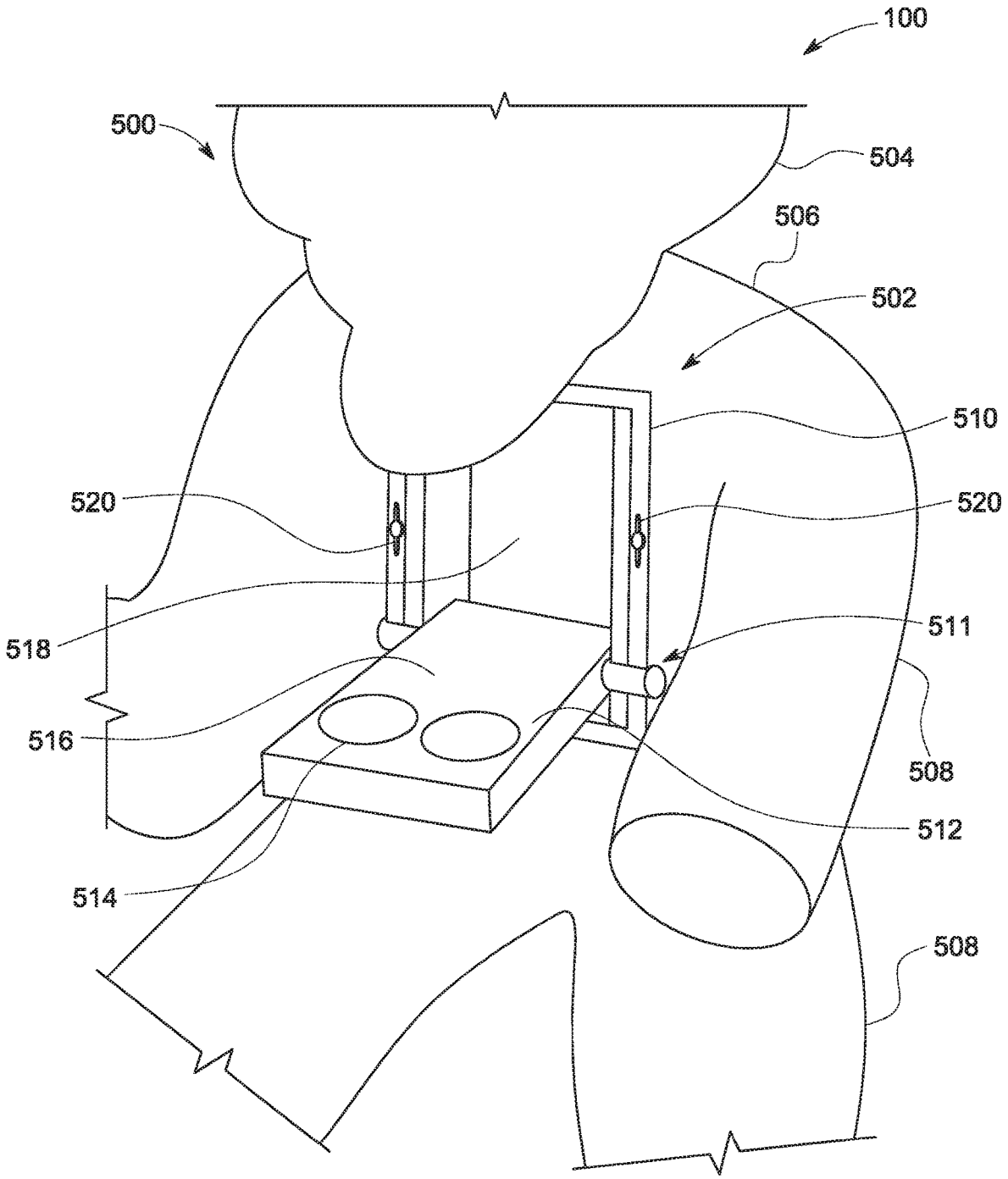
FIG. 5 illustrates the product as a creature that includes a tray system.

FIG. 5 illustrates the product 100 as a creature 500 that includes a flip-down tray system 502. The creature 500 closely resembles the bear 200 of FIG. 2 and the primate 300 of FIG. 3, in several ways, and yet may be a koala bear. All are creatures having a head, main body, and four limbs, and each are designed to be deployed in a predominantly upright position with limbs (arms and legs) extended forward horizontally. The creature 500 has member parts of a head 504, main body 506, and four limbs 508, where the limbs 508 are extended forward horizontally.

The tray system 502 includes a housing frame 510 and a flip-down tray 512. The flip-down tray 512 further includes at least one cup holder 514 and a surface 516 on which items (e.g., treats, food, toys, etc.) can be placed. The flip-down tray 512 can be hingedly attached to the housing frame 510 via a hinge mechanism 511. Thus, in an open position, the flip-down tray 512 opens to a substantially horizontal orientation so that the surface 516 is also horizontal. In one example implementation, the tray 512 swings through a maximum angle of ninety degrees between the open and closed positions.

Figure 6:
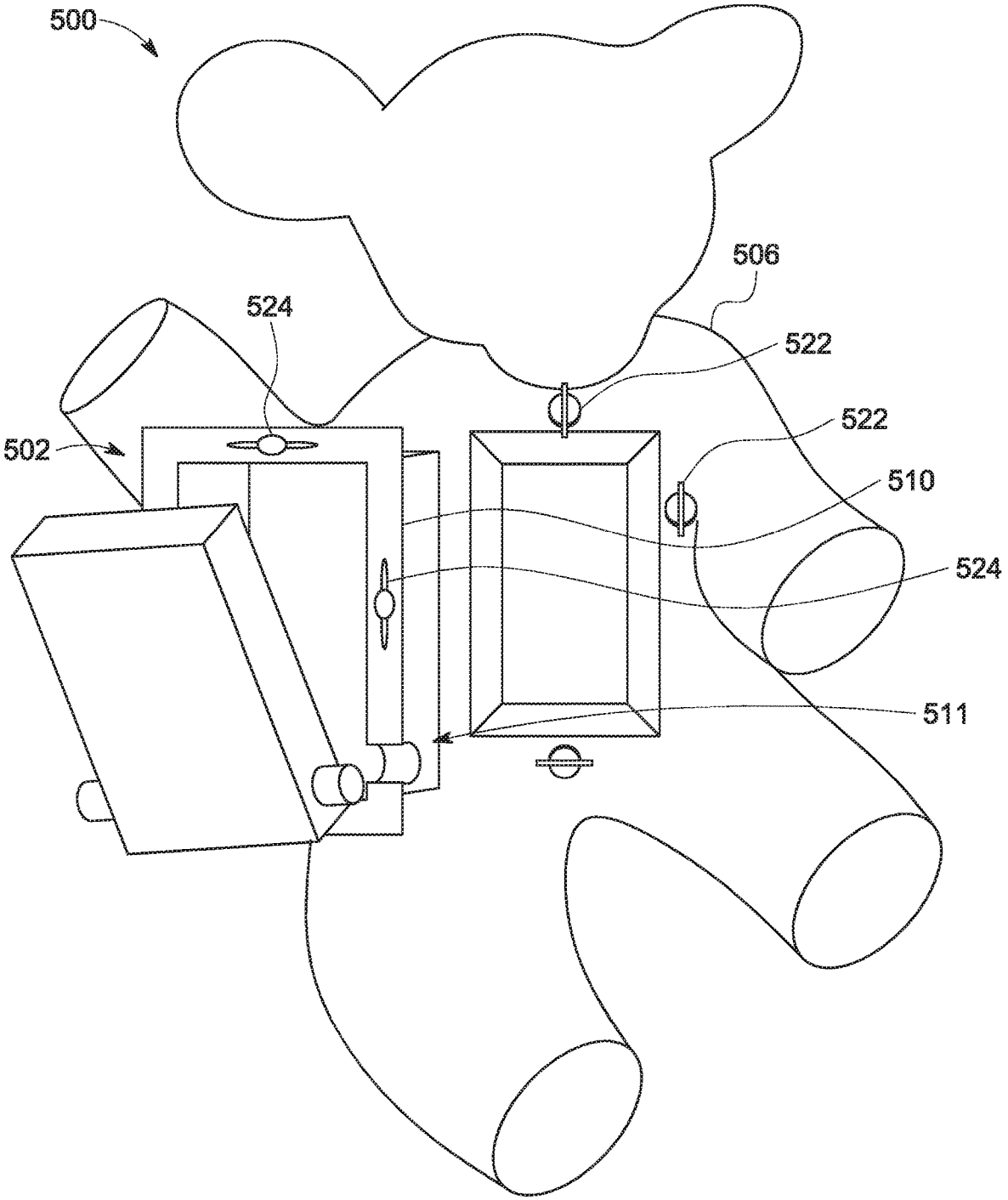
FIG. 6 illustrates the creature of FIG. 5 where the tray system is removable.

The housing frame 510 includes a recessed portion 518 into which the tray 512 swings closed to a stored position. The tray 512 can then be latched into the recessed portion 518 to be secure during handling, for example. The recessed portion 518 is then designed to be similarly constructed into a cover recessed portion as shown in FIG. 6. Thus, the tray system 502 is conveniently out of the way when in the closed and secured position.

The housing frame 510 can be attached to the front part of the main body 506 by way of a quick release-attachment mechanism 520. The quick release-attachment mechanism 520 can be any suitable mechanism that facilitates easy release and attachment of the tray system 502 (e.g., hook-and-loop, magnetics, etc.).

In one implementation, the quick release-attachment mechanism 520 comprises quarter turn buttons 522 (fasteners, latches, etc.) (e.g., four each, one button on each side of the housing frame 510) that insert through mating slots 524 of the housing frame 510. Thus, when turned in one way, the quarter turn buttons secure the housing frame 510 to the main body 506, and when turned the other way, the quarter turn buttons release the housing frame 510 from the main body 506. In this implementation, the quarter turn buttons, for example, are fabricated into the product cover 110 on the creature 500 and the mating slots 524 that receive the buttons 522 incorporated into the perimeter of the housing frame 510.

FIG. 6 illustrates the creature 500 of FIG. 5, where the tray system 502 is removable. The tray system 502 can be removed from and replaced back into, the main body 506. Additionally, here, the flip-down tray 512 can be detached from the housing frame 510, as well, via the hinge mechanism 511. The hinge mechanism 511 operates to couple the tray 512 to the housing frame 510 in a pivotal way while also capturing the tray 512 to the frame 510 when in the closed position so the tray does not fall out of the frame 510 when the tray 512 is not in use.

Figure 7:
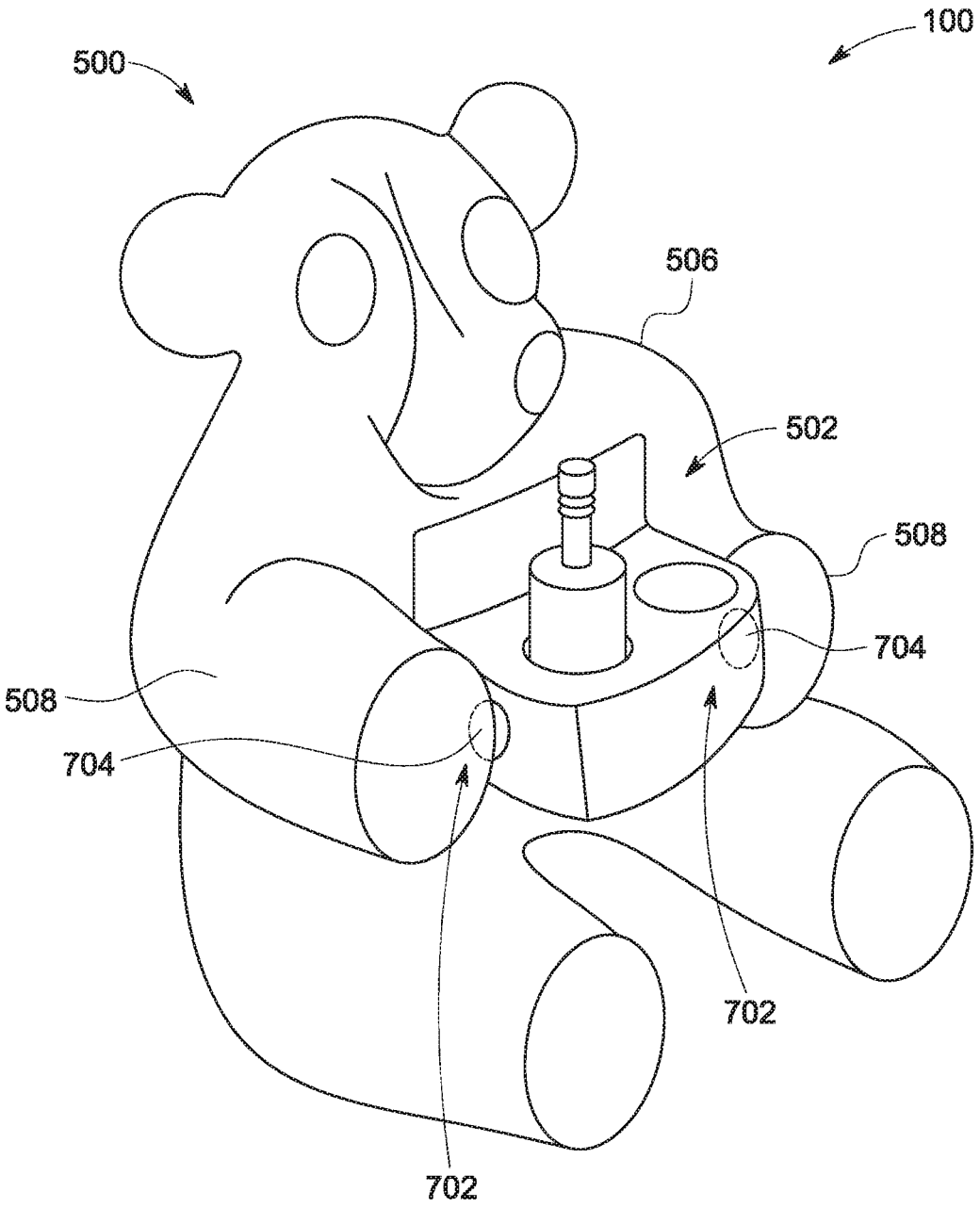
FIG. 7 illustrates the creature of FIG. 5 where the tray system is captured and stabilized by the creature limbs.

FIG. 7 illustrates the creature 500 of FIG. 5, where the tray system 502 is captured and stabilized by the creature arms. The tray system 502 can be removed entirely from the main body 506 and supported solely by contact with limbs 508 (e.g., arms, legs), and front of the main body 506 using any suitable contact material on the corresponding body members such as hook-and-loop tape or patches.

In this example, the interior sides of the arms 702 includes one part (e.g., a hook patch) of a two-part hook-and-loop attachment mechanism 704, and the tray system 502 includes corresponding second parts such as loop parts of the hook-and-loop attachment mechanism 704. Thus, the user can position the tray system 502 and press the arms inward so that the parts of the attachment mechanism 704 engage to capture and stabilize the tray system 502 for use. Compatible length adjustable hook-and-loop tethers can also be employed from the limbs 508 to the tray system 502.

The number and locations of attachment points of the attachment mechanisms can be several, limited only by the design of the creature 500 (and the other creatures described herein). For example, one or more attachment points can be on the chest and/or lower main body areas of the creature 500 with mating attachment part(s) on the back of the tray system 502.

Put another way, the disclosed products can be soft products in shapes of various creatures. A product can comprise a product cover fabricated into the shape of the creature and member parts of the creature, the product cover stuffed with stuffing material to hold the shape of the creature and the member parts in a predetermined orientation. The product can further comprise a compartment system formed into a member part and capable of receiving an item, the compartment system comprising a compartment into which the item is placed and a compartment cover that mates to the compartment to capture the item in the compartment and enable access to the item.

The creature can be a primate, and the product cover can be formed into the shape of the primate and associated primate member parts, the primate member parts include at least one of a head, main body, arms, or legs. The main body can further comprise the compartment and compartment cover. The compartment cover opens and remains in a horizontal position. The compartment cover closes on the compartment and remains closed based on a mechanical closure apparatus. At least one of the compartment or the compartment cover are removable from the product.

The compartment cover is hinged to the compartment and opens downward into a horizontal position to expose a flat surface in a horizontal plane on which the item can be placed, the compartment cover comprising a cup holder for holding a drink container in an upright orientation to prevent spillage.

The compartment and compartment cover serve as a tray system formed into a member part. The creature can be a bear, and the product cover is formed into the shape of the bear and associated bear member parts. The bear member parts include at least one of a head, main body, legs, or arms, the main body further comprises the compartment and compartment cover, the at least one of the bear member parts includes a cup holder constructed thereinto to receive a drink container in a non-spill orientation.

The creature can be a marine animal, and the product cover is formed into the shape of the marine animal and associated marine animal member parts, the marine animal member parts include at least one of a head, main body, or at least a fin. The compartment system is formed into the main body of the marine animal and under a fin, the fin includes the compartment cover and opens to expose the compartment in which nutrition can be stored and from which the nutrition can be accessed and consumed.

The marine animal further comprises a cup holder as part of the head, the cup holder constructed thereinto to receive a drink container in a non-spill orientation. The compartment and compartment cover serve as a standalone unit that can be removed from the product and captured in a stable manner by at least two member parts of the creature for access to the item.

Put in yet another way, a soft product in a shape of a creature is disclosed, comprising a product cover fabricated into the shape of the creature and member parts of the creature, the member parts include at least a head and a main body, the product cover stuffed with stuffing material to maintain the shape of the creature, maintain orientation of the creature, and maintain orientation of the member parts relative to the main body; and a compartment and a compartment cover formed into the main body member part, through the product cover, and capable of receiving an item, the compartment cover attached to the compartment to enclose the item in the compartment for storage and enable access to the item when open, the compartment and compartment cover removable from main body for use as a standalone unit.

What has been described above includes examples of the disclosed architecture. It is, of course, not possible to describe every conceivable combination of components and/or methodologies, but one of ordinary skill in the art may recognize that many further combinations and permutations are possible. Accordingly, the novel architecture is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A soft product in a shape of a creature, comprising:

a product cover fabricated into the shape of the creature and member parts of the creature, the product cover stuffed with stuffing material to hold the shape of the creature and the member parts in a predetermined orientation;

a compartment system formed into a member part and capable of receiving an item, the compartment system comprising a compartment into which the item is placed and a compartment cover that mates to the compartment to capture the item in the compartment and enable access to the item; and a holder, separate from the compartment system, and constructed into a member part of the creature to receive a drink container in a non-spill orientation, the member part at east one of a head, arm, or leg.

2. The soft product of claim 1, wherein the creature is a primate, and the product cover is formed into the shape of the primate and associated primate member parts, the primate member parts include at least one of a head, main body, arms, or legs.

3. The soft product of claim 2, wherein the main body further comprises the compartment and compartment cover.

4. The soft product of claim 2, wherein at least one of the primate member parts includes a cup holder as the holder constructed thereinto to receive a drink container in a non-spill orientation.

5. The soft product of claim 1, wherein the compartment cover opens and remains in a horizontal position.

6. The soft product of claim 1, wherein compartment cover closes on the compartment and remains closed based on a mechanical closure apparatus.

7. The soft product of claim 1, wherein at least one of the compartment or the compartment cover are removable from the product.

8. The soft product of claim 1, wherein the compartment cover is hinged to the compartment and opens downward into a horizontal position to expose a flat surface in a horizontal plane on which the item can be placed, the compartment cover comprising a cup holder for holding a drink container in an upright orientation to prevent spillage.

9. The soft product of claim 1, wherein the compartment and compartment cover serve as a tray system formed into a member part.

10. The soft product of claim 1, wherein the creature is a bear, and the product cover is formed into the shape of the bear and associated bear member parts, the bear member parts include at least one of a head, main body, legs, or arms, the main body further comprises the compartment and compartment cover, the at least one of the bear member parts includes the holder constructed thereinto to receive a drink container in a non-spill orientation.

11. The soft product of claim 1, wherein the creature is a marine animal, and the product cover is formed into the shape of the marine animal and associated marine animal member parts, the marine animal member parts include at least one of a head, main body, or fins.

12. The soft product of claim 11, wherein the compartment system is formed into the main body of the marine animal and under a fin, the fin includes the compartment cover and opens to expose the compartment in which nutrition can be stored and from which the nutrition can be accessed and consumed.

13. The soft product of claim 11, wherein the marine animal further comprises a cup holder as the holder and as part of the head, the cup holder constructed thereinto to receive a drink container in a non-spill orientation.

14. The soft product of claim 1, wherein the compartment and compartment cover serve as a standalone unit that can be removed from the product and captured in a stable manner by at least two member parts of the creature for access to the item.

15. A soft product in a shape of a creature, comprising:

a product cover fabricated into the shape of the creature and member parts of the creature, the member parts include at least a head and a main body, the product cover stuffed with stuffing material to hold the shape of the creature and the member parts;

a compartment and a compartment cover formed into the main body member part and capable of receiving an item, the compartment cover attached to the compartment to enclose the item in the compartment and enable access to the item; and a holder, separate from the compartment system, and constructed into a member part of the creature, the member part at least one of a head, arm, or leg.

16. The soft product of claim 15, wherein the creature is a primate, and the product cover is formed into the shape of the primate and associated member parts of the primate, the member parts of the primate include the head, the main body, and at least one of legs or arms, the at least one of the legs or arms includes a cup holder as the holder constructed thereinto to hold a drink container in a non-spill orientation.

17. The soft product of claim 15, wherein the creature is a bear, and the product cover is formed into the shape of the bear and associated member parts of the bear, the bear member parts include the head, the main body, legs, and arms, the main body further comprises the compartment and compartment cover, at least one of the bear member parts includes a cup holder as the holder constructed thereinto to receive a drink container in a non-spill orientation.

18. The soft product of claim 15, wherein the creature is a marine animal, and the product cover is formed into the shape of the marine animal and associated member parts of the marine animal, the marine animal member parts include the head, the main body, and at least a fin, the compartment is formed into the main body of the marine animal and under a fin, the fin included as part of the compartment cover and opens to expose a container in which nutrition can be stored and from which the nutrition can be consumed, the marine animal further comprises a cup holder as part of the head, the cup holder as the holder constructed thereinto to receive and hold a drink container in a non-spill orientation.

19. A soft product in a shape of a creature, comprising:

a product cover fabricated into the shape of the creature and member parts of the creature, the member parts include at least a head and a main body, the product cover stuffed with stuffing material to maintain the shape of the creature, maintain orientation of the creature, and maintain orientation of the member parts relative to the main body;

a compartment and a compartment cover formed into the main body member part, through the product cover, and capable of receiving an item, the compartment cover attached to the compartment to enclose the item in the compartment for storage and enable access to the item when open, the compartment and compartment cover removable from main body for use as a standalone unit; and a holder, separate from the compartment and compartment cover, and constructed into a member part of the creature, the member part at least one of a head, arm, or leg.

20. The soft product of claim 19, wherein the creature is a primate, marine animal, or bear, the holder is a cup holder constructed into at least one member of the creature, to receive a container in a non-spill orientation.

* * * * *